US009879942B1

(12) United States Patent
Concannon et al.

(10) Patent No.: US 9,879,942 B1
(45) Date of Patent: Jan. 30, 2018

(54) RAIL LOCK RISER

(71) Applicants: Michael A. Concannon, Concord, MA (US); Chris M. Li, Acton, MA (US); Kevin M. Li, Brighton, MA (US)

(72) Inventors: Michael A. Concannon, Concord, MA (US); Chris M. Li, Acton, MA (US); Kevin M. Li, Brighton, MA (US)

(73) Assignee: Concord Armory LLC, Concord, MA (US)

( * ) Notice: Subject to any disclaimer, the term of this patent is extended or adjusted under 35 U.S.C. 154(b) by 0 days.

(21) Appl. No.: 14/605,969

(22) Filed: Jan. 26, 2015

Related U.S. Application Data

(60) Provisional application No. 61/932,726, filed on Jan. 28, 2014.

(51) Int. Cl.
*F41C 33/06* (2006.01)
*F41C 27/00* (2006.01)

(52) U.S. Cl.
CPC ..... *F41C 27/00* (2013.01); *F41C 33/06* (2013.01)

(58) Field of Classification Search
CPC ..... F41C 27/00; F41C 33/00; F41C 33/006; F41C 33/007; F41C 33/008; F41C 23/16; F41C 33/001; F41C 33/0254; F41C 33/0263; F41G 11/003; F41G 11/004; F41G 11/005; F41A 23/00; F41A 23/18; F41A 23/10; F41A 23/08; F41A 23/16; F41A 35/00
USPC ..... 42/90; 70/58
See application file for complete search history.

(56) References Cited

U.S. PATENT DOCUMENTS 5,779,120 A * 7/1998 Morford ..... B60R 7/14 224/311
6,330,815 B1 * 12/2001 Duncan ..... B60R 7/14 211/4
6,854,206 B2 * 2/2005 Oz ..... F41G 1/34 42/111
7,905,041 B1 * 3/2011 Davies ..... F41A 3/66 42/75.02
8,341,866 B1 * 1/2013 Gaddini ..... F41G 11/003 42/71.01
8,713,838 B2 * 5/2014 Ubl ..... F41A 11/02 42/71.01
8,826,702 B1 9/2014 Barger
8,863,426 B1 * 10/2014 Zinsner ..... F41C 23/16 42/71.01
9,021,728 B1 * 5/2015 Kocmich, IV ..... F41A 23/04 248/562
9,513,074 B1 * 12/2016 Steil ..... F41A 5/18
(Continued)

*Primary Examiner* — John Cooper
(74) *Attorney, Agent, or Firm* — Loginov & Associates, PLLC

(57) ABSTRACT

A rail lock riser assembly comprising a rail interface having a cutout, top surface with a through-hole, and shoulders; a first collar portion having a top outer tongue and a groove, a bottom outer tongue and a groove, mounting shoulders and a through-hole in the top outer tongue; a second collar having a top inner tongue and a groove, a bottom inner tongue and a groove, mounting shoulders and a through-hole in the top inner tongue; and a locking bolt. The collar portions are joined at the top outer tongue and groove and the bottom outer tongue and groove. The combined tongues of the first and second collar portions is inserted into the cutout of the rail interface and secured by the locking bolt.

13 Claims, 4 Drawing Sheets

(56) References Cited

U.S. PATENT DOCUMENTS

| | | | | |
|---|---|---|---|---|
| 2003/0230022 | A1* | 12/2003 | Battaglia | F41G 11/003 42/111 |
| 2005/0000142 | A1* | 1/2005 | Kim | F41G 11/003 42/124 |
| 2005/0011104 | A1* | 1/2005 | Oz | F41G 1/34 42/124 |
| 2007/0180752 | A1* | 8/2007 | Houde-Walter | F41G 1/35 42/114 |
| 2009/0293334 | A1* | 12/2009 | Swan | F41C 33/007 42/90 |
| 2010/0170133 | A1* | 7/2010 | Swan | F41C 23/02 42/85 |
| 2010/0175293 | A1* | 7/2010 | Hines | F41C 23/16 42/71.01 |
| 2011/0173868 | A1* | 7/2011 | Wilson | F41A 23/18 42/95 |
| 2011/0239512 | A1* | 10/2011 | Kleven | F41C 23/02 42/85 |
| 2014/0047755 | A1* | 2/2014 | McClintock | F41C 27/00 42/90 |

* cited by examiner

RAIL LOCK RISER

RELATED APPLICATIONS

This application claims the benefit of U.S. Provisional Application Ser. No. 61/932,726, filed Jan. 28, 2014, entitled RAIL LOCK RISER, the entire disclosure of which is herein incorporated by reference.

FIELD OF THE INVENTION

The field of this invention relates to firearms accessories and more particularly, to firearms locks.

BACKGROUND OF THE INVENTION

Law enforcement, paramilitary and military personnel typically carry advanced firearms systems for offensive and defensive activities. These systems include gas-operating rifles. Contemporary military technology includes the attachment of various accessories, including sights, illumination devices and other devices to the barrel of the firearm, notably to the hand grips along the barrel. Accessory mounts for weapons began with the development of the Weaver rail mount system that was the first standardized scope mount for rifles. The mount was improved in the 1980s and became the Picatinny rail system, a universal accessory system for military and paramilitary weapons. The Picatinny rail device has now relocated the foregrips on many military and paramilitary weapons systems. The foregrip is a handling structure located ahead of the firing action and along the barrel assembly of a modern firearm. The barrel assembly of a modern firearm typically includes a gas tube structure for the transfer of combustion gases from a forward port back along the barrel to a gas port located in the firing action assembly. The front end of the foregrip is nearer to the opening of the barrel. The rear or back end of the foregrip is closer to the firing action of the firearm. Today, one or more accessories can be mounted, including but not limited to tactical lights, laser aiming modules, night vision devices, reflex sights, foregrips, bipods and bayonets. Picatinny rails and accessories have relocated iron sights in the design of many firearms and are now incorporated into pistol frames and grips. Picatinny locking slot dimensions are standardized such that the slot width is 5.23 mm. The slot centers are spaced apart by 10.01 mm. Weaver slots are less standardized, but have a uniform slot width of 4.57 mm. Accessories can be attached and detached by sliding them onto the rail from one end or the other, by clamping with bolts, thumbscrews or levers; or onto the slots between the raised sections or the rails.

The various rail systems for firearms utilize the particular geometry of the firearm without alterations to the barrels or fixed mechanisms particular to the function of the weapon. For example, the foregrips of a Colt AR-15, M-4 family of carbines or similar weapon are held in place by tension springs that hold collars over locking shoulders on the ends of the grips. The rail system shape at the ends conforms to the basic hand grips so that it replaces the existing grips without requiring modification to the barrel assembly or upper receiver of the weapon and uses the existing tension spring collars.

U.S. patent application Ser. No. 13/919,604, entitled VEHICLE MOUNTED FIREARM LOCK (the teachings of which are incorporated by reference as a useful background information), teaches a system for locking down a firearm via its rail system. Such locks are provided with a receiving slot that is constructed and arranged to receive a portion of an accessory rail on a firearm. A disadvantage of such systems is that the disconnection of the rail from the firearm barrel group can lead to unauthorized removal of a secured firearm from the lock, albeit without the accessory rail portion retained by the lock. However, given that the accessory rail is a fungible and non-registered item, it is a small loss compared with the firearm in terms of value. The rail lock riser can work in conjunction with devices that secure the upper receiver to the lower receiver. It would be desirable to provide a device that supports an accessory rail within a firearms lock that cannot be readily removed from the firearm.

SUMMARY OF THE INVENTION

The present invention overcomes the disadvantages of the prior art by providing a rail lock riser assembly having a locking bolt inside the riser assembly that is constructed and arranged to be recessed and concealed when the rail lock riser assembly with an attached firearm is received into a vehicle mounted firearm locking mechanism so that access to the locking bolt and the attached firearm is restricted when in a locked configuration. The rail lock riser assembly is comprised of a rail interface having a cutout, top surface with a through-hole, and shoulders; a first collar portion having a top outer tongue and a groove, a bottom outer tongue and a groove, mounting shoulders and a through-hole in the top outer tongue; a second collar having a top inner tongue and a groove, a bottom inner tongue and a groove, mounting shoulders and a through-hole in the top inner tongue; and a locking bolt. The top outer tongue and groove of the first collar portion are an interlocking geometry that removably engages the top inner tongue and groove of the second portion and the bottom outer tongue and groove of the first collar portion removably engages the bottom inner tongue and groove of the second collar portion. The top outer tongue of the engaged first collar portion and second collar portion is inserted into the cutout of the rail interface. The locking bolt is inserted into the through-hole in the rail interface and passes through the top outer tongue of the first collar portion and into the top inner tongue of the second collar portion and locks the assembly in an assembled configuration. The rail lock riser assembly is assembled on a firearm having the rail lock riser assembly and is placed into a firearms locking device that secures the firearm by engaging and retaining the rail interface. The rail lock riser assembly cannot be removed from the firearm so long as the locking bolt is within the firearms locking device. The rail lock assembly can be mounted on the firearm at the front of the foregrip and/or at the rear of the foregrip. A method for securing a firearm with a rail system in a vehicle mounted firearms lock comprising the steps of attaching a rail lock riser assembly on either a front end or rear end of a foregrip into engagement with a vehicle mounted firearm locking mechanism that receives the rail riser assembly; and positioning the rail lock riser assembly in a locked position in the vehicle mounted firearm locking mechanism so that a locking bolt that secures the components of the rail lock riser assembly to a foregrip is concealed.

BRIEF DESCRIPTION OF THE DRAWINGS

The invention description below refers to the accompanying drawings, of which.

DETAILED DESCRIPTION

Figure 1:
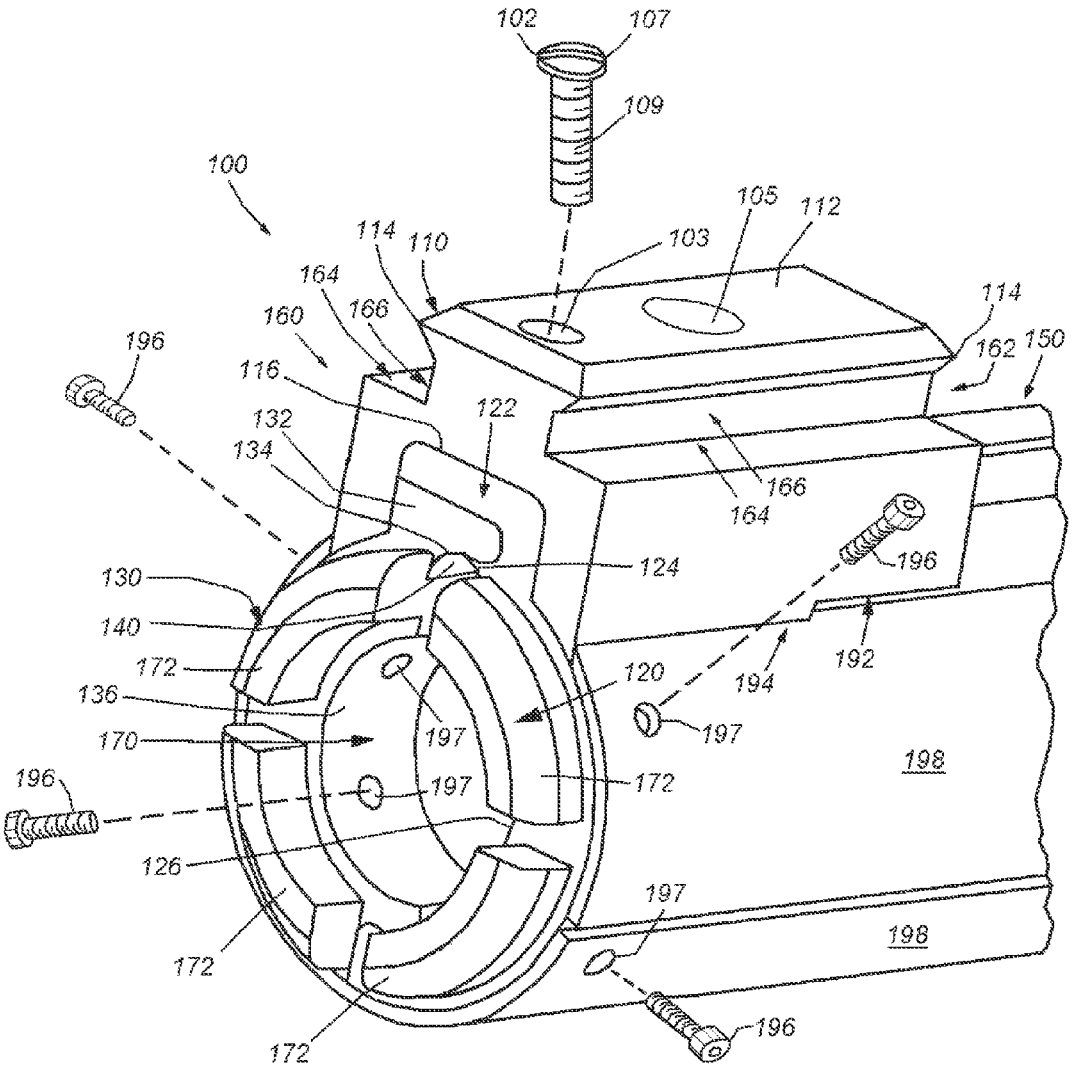
FIG. 1 is a perspective view of a firearm rail lock riser in an assembled configuration, according to an illustrative embodiment.

In an embodiment, an illustrative rail lock riser is depicted in FIG. 1 in an assembled configuration. The illustrative rail lock riser assembly 100 is a lock mechanism that is comprised of four parts, a locking bolt 102, a rail interface 110, a first collar portion 120 and a second collar portion 130. The first collar portion 120 removably engages the second collar portion 130 at the top and bottom of the collars and together removably engage the rail interface 110. The rail interface 110 is provided with a top rail surface 112 and opposing shoulders 114 that are constructed and arranged to closely engage a receiver for a rail (not shown). The inside portion of the rail interface is provided with a cutout 116 that receives the top outer tongue 122 of the first collar portion 120 and the top inner tongue 132 of the second collar portion 130. The rail interface 110 is provided with two through-holes 103 and 105 in the top rail surface 112. Through-hole 105 is an illustrative hole for locking the rail into a locking system. Through-hole 103 is for receiving locking bolt 102. The top rail surface 112 and shoulders 114 are the locking surfaces that are retained and secured by a lock. Locking bolt 102 resides within through-hole 103 and passes through the top outer tongue 122 and the top inner tongue 132 to secure the two collar portions 120, 130 to the rail interface 110 and removably combines these portions to form the rail lock riser assembly 100. Bolt 102 is illustratively a threaded bolt and can be provided with sockets for use of a common screw-driver, a Phillips screw driver, and Allen hex wrench or another driver system (e.g., the Torx® system). The locking bolt 102 is comprised of a bolt head 107 and threaded shaft 109. Bolt 102 is depicted as being of various sizes and dimensions. In other embodiments, they can be sized differently or of the same dimensions. The rail lock riser assembly 100 cannot be removed from the firearm 150 without access to the locking bolt 102. When the locking bolt 102 is inserted into through-hole 103, the collar portions 120, 130 and the rail interface 110 become a unitary structure and that structure can resist reasonable torque forces and tampering attempts. The rail as depicted in FIG. 1 is not limited to a Picatinny style rail system, and can be a Weaver system or another rail system that accommodates rail accessories. This rail system can include free floating forend grips.

Cutout 140 is formed by an inner surface 134 of the second collar portion 130 and an inner surface 124 of the first collar portion 120. Cutout 140 is a groove that extends from the front 160 to the rear 162 of the rail lock riser assembly 100 and is sized and arranged so that gas in the gas tube of the weapon can pass through the rail lock riser assembly 100 without interruption. Top shoulders 164 and sidewalls 166 are surfaces of the rail interface 110 that engage with the external locking system (not shown). Inner aperture 170 is formed by the inner surfaces 136 and 126 of the respective collar portions 130, 120 and is sized and arranged to accommodate the barrel of the firearm (not shown). Shoulders 172 are provided to the collar portions 120, 130 for engagement with the firearm. The rail lock riser assembly 100 can be constructed of a cast metal, such as zinc alloy, aluminum alloy, or other lightweight metal that is machined from bar/rod stock and/or forged. In various embodiments, the rail lock riser assembly 100 can be cast from a synthetic polymer, a ceramic, a fiber (glass, carbon, nylon, etc.) composite, or a combination thereof. A step 192 along the lower edge 194 of the rail lock riser is provided so that the riser can clear the firearm's delta ring (not shown), and to ease movement along the rail. The size and shape of this step is highly variable in illustrative embodiments. Retaining bolts 196 reside within through-holes 197 and connect the respective collar portions 130, 120 to grip shrouds 198 to maintain alignment and integrity of the structure. The overall weight of the assembled rail lock riser assembly 100 is approximately 6 ounces. The rail lock riser assembly 100 can be constructed and arranged to be placed at either end of a foregrip assembly, nearer to the rear or to the front of the barrel, or with a rail lock riser assembly 100 mounted at both ends at the same time.

Figure 2:
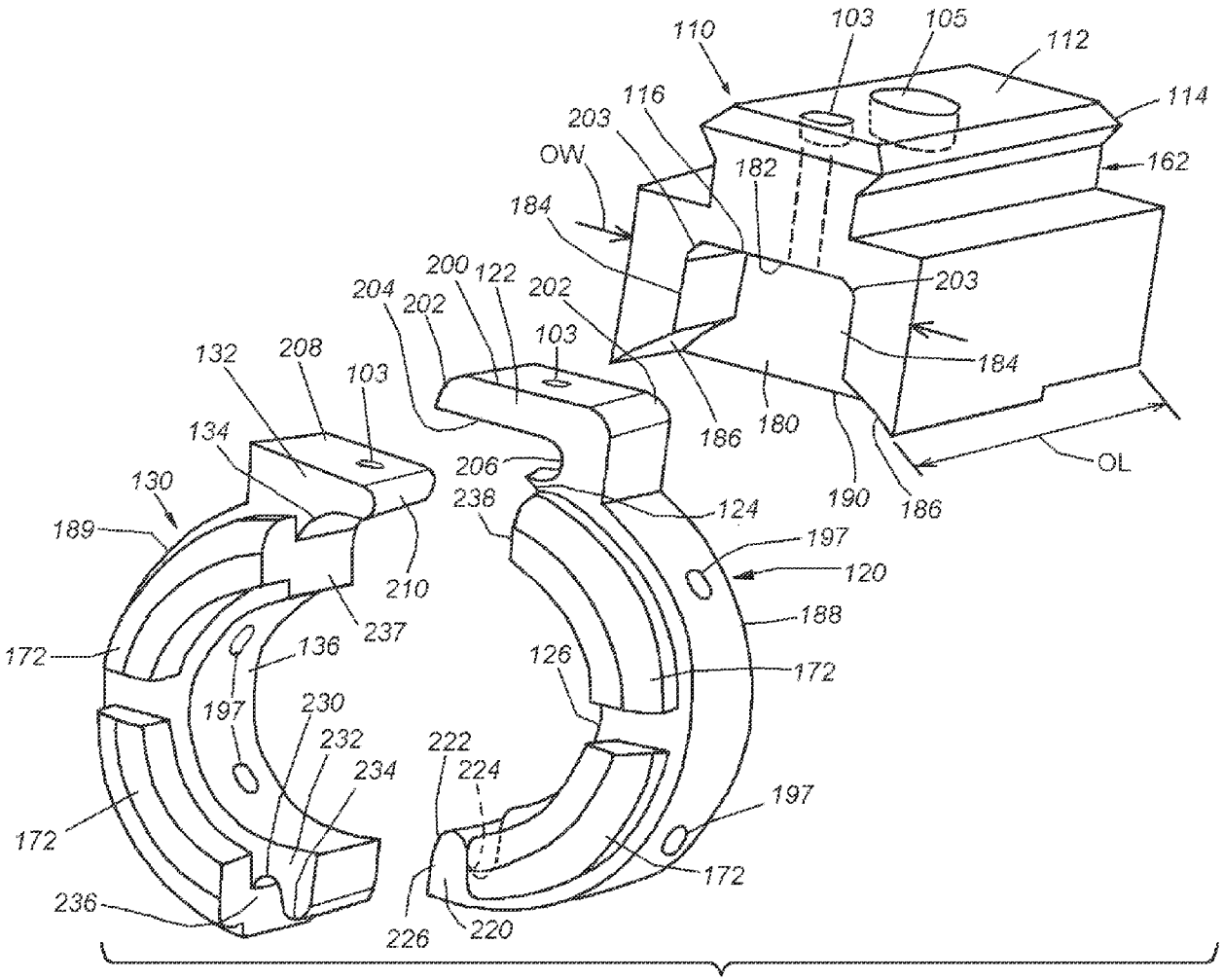
FIG. 2 is an exploded perspective view of the rail lock riser of FIG. 1 in an unassembled configuration, according to the illustrative embodiment.

FIG. 2 depicts the illustrative rail interface 110, the first collar portion 120 and the second collar portion 130 in a disassembled configuration. Cutout 116 is comprised of back wall 180, horizontal top wall 182 and sidewalls 184. As noted above, the proportions of the cutout 116 are sized to receive the combined upper tongues of the collar portions 120, 130. The overall length OL of the rail interface 110 is approximately 1.5 inches. The overall width OW of the rail interface 110 is approximately 1.25 inches. Curved inner surfaces 186 are sized to receive outer surface 188 of the first collar portion 120 and outer surface 189 of the second collar portion 130. Through-hole 103 extends from the top rail surface 112 to the horizontal top wall 182. The tongue refers to an over-lapping and/or under-lapping portion that is part of the interlocking geometry. It is expressly contemplated that this geometry can vary and include other species of interlocking geometry, for example, a dovetail joint. The above-noted dimensions can be greater or lesser, depending on the barrel length and width of the underlying weapons system. For example, a rail for a handgun is smaller than a rail for a carbine, which is in turn smaller than the rail for a large bore sniper weapon. Accordingly, these should not be taken as absolute dimensions.

The first collar portion 120 is provided with a top outer tongue 122 that is constructed and arranged with a top tongue surface 200 that has rounded surfaces 202. The top tongue surface 200 and rounded surfaces 202 are constructed so as to engage with the bottom surface 182 and inner curved surfaces 203 of cutout 116. Likewise, the horizontal bottom surface 204 and curved surface 206 of the first collar portion 120 are constructed so as to engage with the top surface 208 and curved shoulder surface 210 of the top inner tongue 132 of the second collar portion 130. A bottom outer tongue 220 is provided with a curved inner surface 222, inner groove 224 and vertical surface 226. The curved inner surface 222 engages with a groove 230 of the bottom inner tongue 232 of the second collar portion 130. Inner groove 224 of the first collar portion 120 engages a curved surface 234 of the second collar portion 130. A vertical wall 226 of the first collar portion engages vertical wall 226 of the second collar portion. Likewise, vertical wall 237 of the second collar portion engages vertical wall 238 of the first collar portion.

Figure 3:
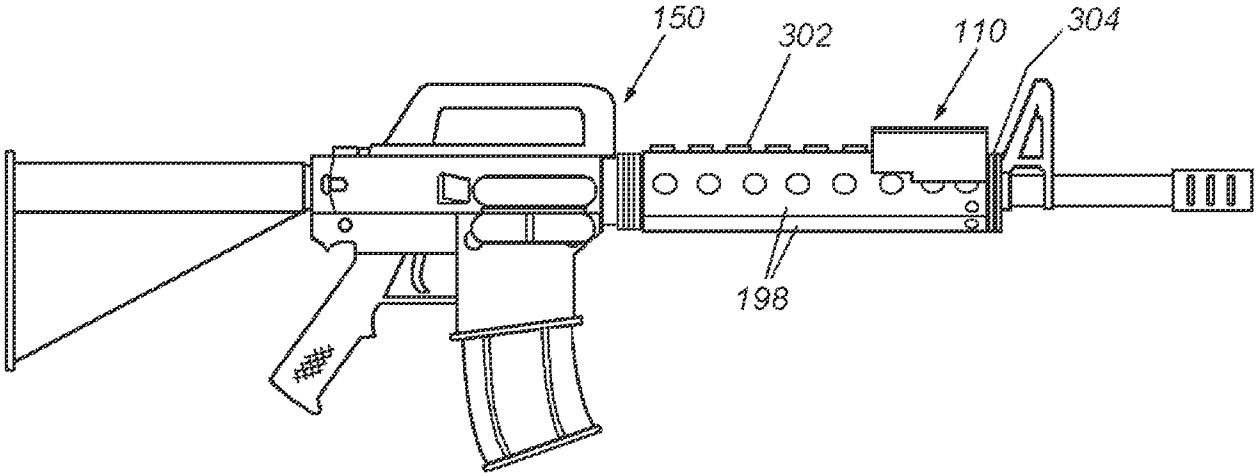
FIG. 3 is a view of the rail lock riser of FIG. 1 mounted on the foregrip of an exemplary firearm, according to the illustrative embodiment.

FIG. 3 shows a rail lock riser assembly 100 in an assembled configuration and situated on the foregrip portion of an illustrative firearm 150 residing between the hand guard assembly 302 and the front hand guard mount 304. When the firearm is placed into a locking system (not shown) that secures the firearm by the rail lock riser assembly 100 into the locking system, the heads of locking bolts 102 and 104 are now within that lock and because they face into the lock, they are inaccessible and hence, the rail lock riser assembly is secured to the firearm. To assemble the rail lock riser assembly, the two collar portions 120, 130 are interlocked at the upper tongues 122, 132 and bottom tongues 222, 234 and placed into the cutout 116. Locking bolt 102 is then inserted and screwed into the through-hole such that it traverses through the rail interface 110, the top outer tongue 122 and the top inner tongue 132 to create an assembled rail lock riser assembly 100 that can be secured to the weapon by inserting and threading locking bolt 104. When the rail lock riser assembly is assembled on a firearm and the locking bolt is inserted into the through-holes, the assembly is secured to the firearm and placement of the firearm into a locking system that engages the rail interface renders the locking bolt inaccessible until the weapon is removed from the lock.

Figure 4:
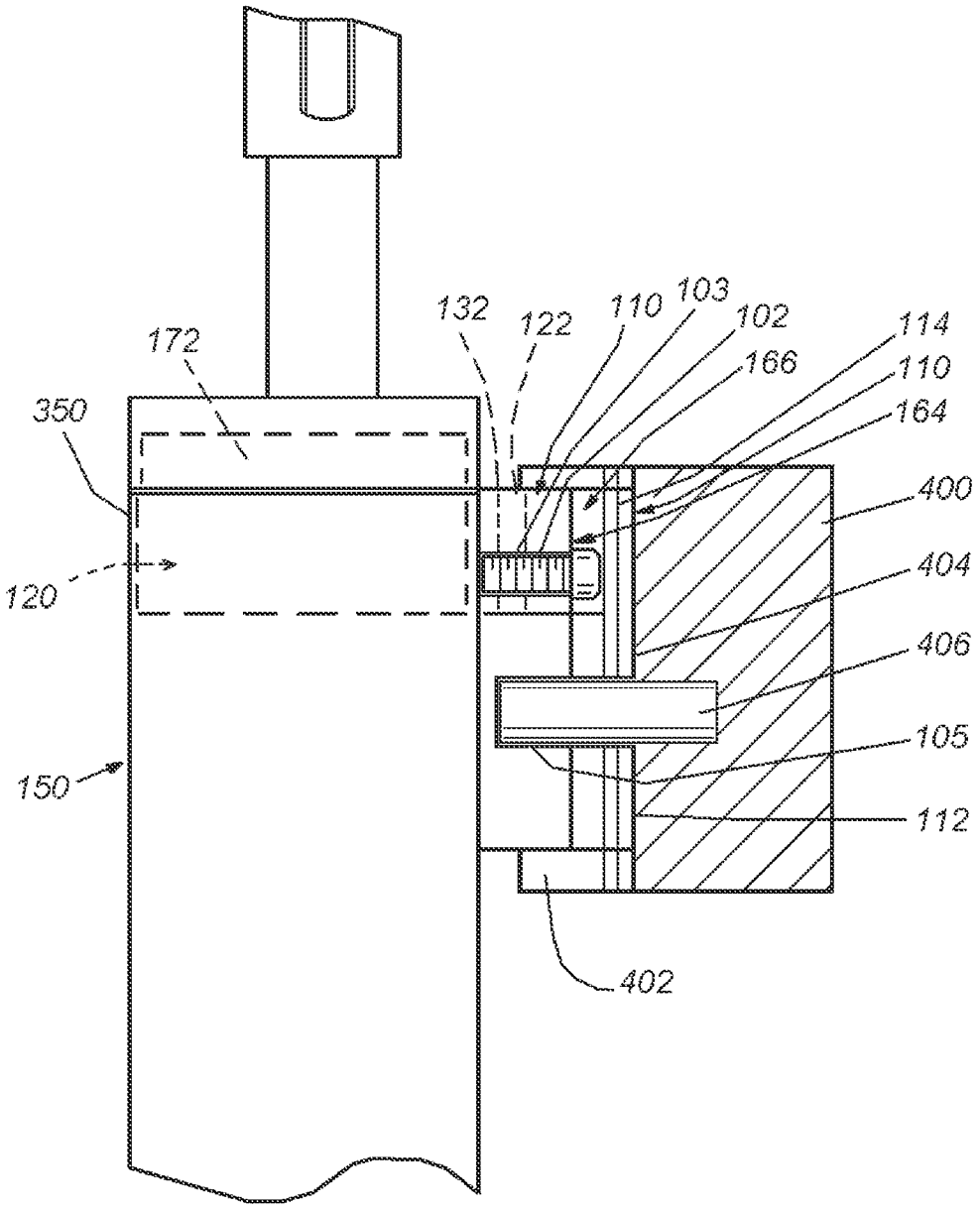
FIG. 4 is a schematic side view of the rail lock riser of FIG. 1 engaged in an exemplary locking system, according to the illustrative embodiment.

FIG. 4 shows an exemplary firearm 150 with the rail lock riser assembly 100 of FIG. 1 attached at the front end of the foregrip 350 engaged in an exemplary vehicle mounted firearm lock mechanism 400 in a locked configuration. The locked configuration is defined as the state of the lock mechanism when a firearm having the illustrative rail lock riser assembly is inserted into the lock mechanism and a lock tumbler is activated to prevent removal of the firearm from the lock mechanism until a key mechanism is activated to remove the tumbler from the rail lock riser assembly. The riser interface 110 is secured in rail channel 402 so that the top surface 112 is in contact with the inner surface 404 of the lock mechanism 400. The insertion of an illustrative lock tumbler 406 into hole 105 prevents the firearm from being removed from the lock mechanism without activation of the key mechanism (not shown) and retraction of the tumbler 406 from hole 105. Locking bolt 102 resides within through-hole 103 and secures the riser interface 110 to the collar portions 120, 130 by their respective upper tongues 122, 132. The locking bolt head 107 is oriented so that it faces the inner surface 404 and cannot be accessed or tampered with without first removing the firearm 150 from the lock mechanism 400. Thus, the firearm 150 is locked into the lock mechanism 400 until the lock mechanism is unlocked.

"Top" and "upper" are each defined as a direction opposite "bottom" and "inner", with "top" being at the approximate maximum point, with "bottom" being at the approximate maximum point. "Inner" is defined as a region or surface facing or in the open space of the aperture 170, while "exterior" is defined as a region or surface facing away from the space of the aperture and/or residing on an outside surface of the base or gate and exposed to the outside environment. More generally, as used herein the directional terms, such as, but not limited to, "up" and "down", "upward" and "downward", "rearward" and "forward", "rear" and "front", "top" and "bottom", "inside" and "outer", "front" and "back", "inner" and "outer", "interior" and "exterior", "downward" and "upward", "horizontal" and "vertical" should be taken as relative conventions only, rather than absolute indications of orientation or direction with respect to a direction of the force of gravity.

It should be clear that the above-described embodiment provides for a superior lock mechanism that conveniently attaches to a rail system of conventional configuration. The lock mechanism advantageously resists intrusion and tampering. The mechanism is relatively straightforward to install, uninstall and maintain.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, the exterior surfaces of the rail lock riser assembly can be coated with a powder coating, bluing, Parkerizing, chrome or another typically durable, weather-resistant finish. More than one locking bolt can be provided. Squared off surfaces can be substituted for rounded surfaces on the tongues. Accordingly, this description is meant to be taken only by way of example, and not to otherwise limit the scope of this invention.

What is claimed is:

1. A rail lock riser assembly comprising:

a riser interface adapted to engage a rail channel of a firearm locking mechanism, the riser interface defining a tumbler bolt hole, the tumbler bolt hole adapted to be engaged by a tumbler bolt of the firearm locking mechanism; and a locking bolt, the locking bolt recessed inside the riser interface, the locking bolt adapted to be covered when the riser assembly is received into the rail channel of the firearm locking mechanism so that access to the locking bolt is restricted by the rail channel when the firearm locking mechanism is in a locked configuration.

2. The rail lock riser assembly of claim 1 wherein the rail lock riser assembly is comprised of:

a rail interface having a cutout, top surface with a through-hole, and shoulders;

a first collar portion having a top outer tongue and a groove, a bottom outer tongue and a groove, mounting shoulders and a through-hole in the top outer tongue; and a second collar having a top inner tongue and a groove, a bottom inner tongue and a groove, mounting shoulders and a through-hole in the top inner tongue.

3. The rail lock riser assembly of claim 2, wherein the top outer tongue and groove of the first collar portion removably engages the top inner tongue and groove of the second portion and the bottom outer tongue and groove of the first collar portion removably engages the bottom inner tongue and groove of the second collar portion.

4. The rail lock riser assembly of claim 2, wherein the top outer tongue of the engaged first collar portion and second collar portion is inserted into the cutout of the rail interface.

5. The rail lock riser assembly of claim 2, wherein the locking bolt is inserted into the through-hole in the rail interface and passes through the top outer tongue of the first collar portion and into the top inner tongue of the second collar portion and locks the assembly in an assembled configuration.

6. The rail lock assembly of claim 2, wherein the rail lock riser assembly can be mounted on the firearm at least one of a position at the front of the foregrip and the rear of the foregrip.

7. A method for securing a firearm with a rail system in a firearms lock comprising the steps of:

assembling a rail lock riser assembly on a firearm;

securing the rail lock riser assembly on the firearm with a locking bolt through the rail;

engaging the rail lock riser assembly within a rail channel of a firearm locking mechanism that receives the rail riser assembly within the rail channel;

positioning the rail lock riser assembly within the rail channel so that the locking bolt that secures the components of the rail lock riser assembly to the firearm is covered within the rail channel; and locking the rail lock riser assembly within the rail channel of the firearm locking mechanism.

8. The method of claim 7, wherein the locking the rail lock riser assembly within the rail channel of the firearm locking mechanism is engaging a tumbler bolt into a tumbler bolt hole in the rail lock riser assembly, thereby securing the rail lock riser assembly within the rail channel of the firearm locking mechanism.

9. A rail lock riser assembly comprising:

a riser interface adapted to engage a rail channel of a firearm locking mechanism, the riser interface defining a tumbler bolt hole, the tumbler bolt hole adapted to be engaged by a tumbler bolt of the firearm locking mechanism, the riser interface comprising:

a rail interface having a cutout, top surface with a through-hole, and shoulders;

a first collar portion having a top outer tongue and a groove, a bottom outer tongue and a groove, mounting shoulders and a through-hole in the top outer tongue; and a second collar having a top inner tongue and a groove, a bottom inner tongue and a groove, mounting shoulders and a through-hole in the top inner tongue; and a locking bolt, the locking bolt recessed inside the riser interface, the locking bolt adapted to be covered when the riser assembly is received into the rail channel of the firearm locking mechanism so that access to the locking bolt is restricted by the rail channel when the firearm locking mechanism is in a locked configuration.

10. The rail lock riser assembly of claim 9, wherein the top outer tongue and groove of the first collar portion removably engages the top inner tongue and groove of the second portion and the bottom outer tongue and groove of the first collar portion removably engages the bottom inner tongue and groove of the second collar portion.

11. The rail lock riser assembly of claim 9, wherein the top outer tongue of the engaged first collar portion and second collar portion is inserted into the cutout of the rail interface.

12. The rail lock riser assembly of claim 9, wherein the locking bolt is inserted into the through-hole in the rail interface and passes through the top outer tongue of the first collar portion and into the top inner tongue of the second collar portion and locks the assembly in an assembled configuration.

13. The rail lock assembly of claim 9, wherein the rail lock riser assembly can be mounted on the firearm at least one of a position at the front of the foregrip and the rear of the foregrip.

* * * * *